US006129227A

United States Patent [19]

Openchowski et al.

[11] Patent Number: 6,129,227

[45] **Date of Patent: *Oct. 10, 2000**

[54] LIGHTWEIGHT KNUCKLE FOR A RAILROAD CAR COUPLER

[75] Inventors: Richard A. Openchowski, Bolingbrook; Scott A. Beatty, Chicago; Andreas M. Haas, Addison; Kenneth F. Packer; Jiten V. Shah, both of Naperville, all of Ill.

[73] Assignee: National Casting Incorporated, Chicago, Ill.

[ * ] Notice: Under 35 U.S.C. 154(b), the term of this patent shall be extended for 303 days.

[21] Appl. No.: 08/636,033

[22] Filed: Apr. 22, 1996

[51] Int. Cl.[7] ..... B61G 3/00

[52] U.S. Cl. ..... 213/111; 213/155

[58] Field of Search ..... 213/111, 112, 213/113, 151, 155

[56] References Cited

U.S. PATENT DOCUMENTS

| | | | |
|---|---|---|---|
| 1,114,604 | 10/1914 | Gilman et al. | 213/111 |
| 1,480,863 | 1/1924 | Packer | 213/111 |
| 3,779,397 | 12/1973 | De Penti | 213/155 |
| 4,605,133 | 8/1986 | Altherr | 213/155 |
| 4,645,085 | 2/1987 | Hanula et al. | 213/155 |
| 5,582,307 | 12/1996 | Hawthorne et al. | 213/155 |

*Primary Examiner*—S. Joseph Morano

[57] ABSTRACT

A lightweight knuckle weighing substantially less than an AAR Standard Knuckle, is described for use in a railroad car coupler. This lightweight knuckle can be used, for example, to replace AAR Standard knuckle which becomes broken or otherwise damaged during operation and requires replacement in the field. Both the contouring and inner coring of an AAR Standard knuckle are radically changed to produce this lightweight knuckle which has all the functioning features of the standard knuckle, so as not to adversely effect the coupling and uncoupling operations of a coupler in which the lightweight knuckle is used.

20 Claims, 4 Drawing Sheets

LIGHTWEIGHT KNUCKLE FOR A RAILROAD CAR COUPLER

BACKGROUND OF THE INVENTION

The invention relates to AAR Standard F and E type railroad car couplers, especially to the knuckles used in these couplers. More particularly, the invention relates to lightweight which can be used in an emergency to replace existing AAR Standard knuckles which become broken or otherwise damaged during operation and need replacement.

At present, such replacement knuckles are AAR Standard knuckles which weigh approximately 78 to 88 pounds, and are carried in the locomotive section of a train. In some cases, it may be necessary for a single operator to carry such a knuckle the length of 25, 50 or even 100 railroad cars to reach a defective knuckle which needs replacement. Then the operator much manipulate the replacement knuckle into position on the coupler, after the damaged knuckle is removed, which is no simple task. In fact, it is a necessary and important job, but a back breaking one to say the least. The invention is designed to alleviate this problem by the provision of a substantially lighter weight knuckle which weighs only about 48 pounds and can be used in an emergency to replace a defective AAR Standard knuckle in most knuckle type railroad car couplers. Most importantly, the integrity of an AAR Standard knuckle has not been compromised. That is, this new lightweight knuckle will function or operate the same as an AAR Standard knuckle in relation to the other components of the coupler and those of an opposing coupler during, for example, the coupling and uncoupling operations.

Briefly stated, careful stress analysis tests have been performed on AAR Standard knuckles to determine what areas of these knuckles can be reduced, in size or weight, or even eliminated without adversely effecting the function or operability of the knuckle. The result is a lightweight knuckle which has a unique contour or shape with different coring, both of which features are designed to eliminate extraneous material inside and outside the knuckle to produce, form a practical standpoint, the lightest possible knuckle which, at present has the strength to withstand pull and buff loads of about 275 KIPs which is adequate for emergency applications, but below the standards required for an AAR Standard full service rating.

This lightweight knuckle utilizes industry standard grade E steel alloy material for excellent strength, toughness, and wear properties, and is compatible with all conventional knuckle type railroad car couplers. Moreover, the other conventional components of this lightweight knuckle, such as locks, throwers, and the AAR Standard mating knuckles, do not need modification, but are fully compatible with this lightweight knuckle. Also, all industry standards as to form, fit, and function of a standard knuckle, such as 10A contour angling, coupling and gathering angles, lock drop and support, and anti-creep functionality, are maintained and not compromised.

DESCRIPTION OF THE DRAWING

The following description of the invention will be better understood by having reference to the accompanying drawing, wherein.

DETAILED DESCRIPTION OF THE DRAWING

Figure 1:
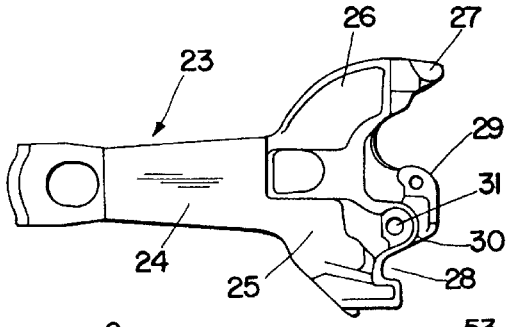
Fig. 1 (PRIOR ART)
FIG. 1 is a plan view of an AAR Standard type F interlocking coupler.

With particular reference to FIG. 1 of the drawing, there is shown an AAR Standard type F interlocking coupler 23 which comprises an elongated shank 24 which terminates at a coupler head 25 which includes a guard arm 26 and nose 27 at one side and a pocket 28 at the opposing side for receiving the guard arm nose of an opposing coupler during the coupling operation of two adjacent type F couplers. An AAR Standard knuckle 29 is mounted on a pivot lug 30 of the coupler head 25, adjacent the pocket 28, by means of a vertical pivot pin 31 for rotation in a horizontal plane, when the coupler 23 is horizontally disposed.

Figure 2:
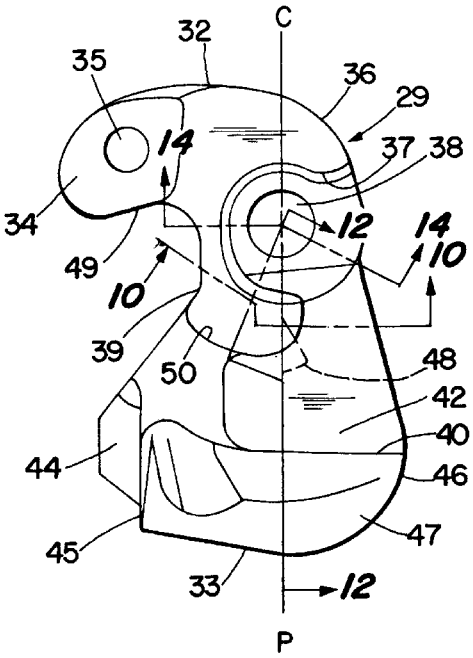
Fig. 2 (PRIOR ART)
FIG. 2 is a plan view of an AAR Standard knuckle.
Figure 3:
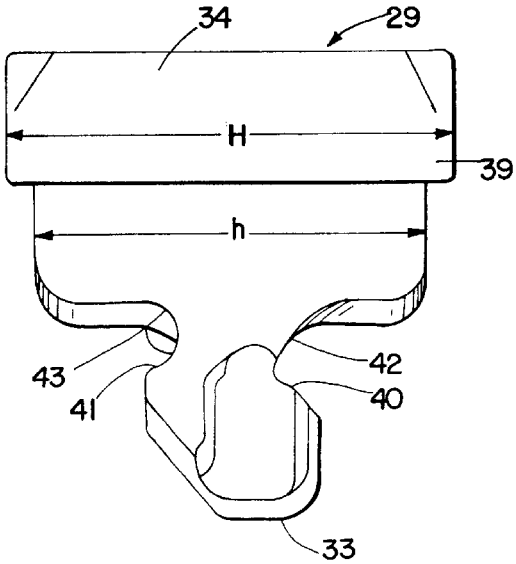
Fig. 3 (PRIOR ART)
FIG. 3 is a guard arm side view of the AAR Standard knuckle.

With general reference to the drawing for like parts, and specific reference to FIGS. 2 and 3, the AAR Standard knuckle 29 is first described, in detail, since the invention involves an adaptation of this standard knuckle 29 which, for descriptive purposes, is assumed to be in a horizontal position. The AAR Standard knuckle 29 comprises a front face 32 which protrudes and slightly curves outwardly from the coupler head 25, and an opposing tail 33 which is oppositely curved and disposed within the coupler head 25, when the standard knuckle 29 is pinned to the coupler 23. The front face 32 terminates at a rounded nose 34 on the so called guard arm side of the standard knuckle 29. The nose 34 is provided with a flag hole 35 and has an overall height H (FIG. 3) which is larger than the general overall height h of the knuckle 29. The curved from face 32 extends from the nose 34 to a rounded heel 36 which converges into similar pin hole protectors 37 with similar, vertically aligned recessed pin holes 38 for receiving the pivot pin 31 for pinning the standard knuckle 29 to the coupler 23. A center plane CP passes through the center of the pin hole 38. The standard knuckle 29 has a curved throat 39 on the guard arm side of the standard knuckle 29, adjacent the nose 34 in closer spaced relation to the tail 33.

A pair of conventional, curved pulling lugs 40 and 41 are formed adjacent the tail 33 on opposite top and bottom sides 42 and 43 of the standard knuckle 29 in predetermined spaced relation from the pin hole 38. A standard, horizontal lock shelf 44 and adjacent vertically disposed locking face 45 are provided on the guard arm side of the tail 33 to support the coupler lock (not shown) in knuckle locking relation, when the standard knuckle 29 is coupled together with the knuckle of an opposing coupler 23. A conventional, tail stop 46 is provided on the knuckle or pocket side of the tail 33 to engage an adjacent inner wall of the coupler head 25 to restrict rotation of the standard knuckle 29 beyond interlocking relation with the knuckle of an opposing coupler 23, thereby minimizing backlash or coupler slack. A horizontal lack ledge 47 is disposed at the tail 33 and leads to the lock shelf 44. The lock ledge 47 supports the lock out of engagement with the lock shelf 44 when the standard knuckle 29 is in an open, uncoupled position. Further, the lock ledge 47 supports the lock as the standard knuckle 29 rotates to a closed or coupled position. That is, the lock ledge 47 supports the lock until the lock is over the lock shelf 44, at which time the lock drops down onto the lock shelf 44 to firmly hold the standard knuckle 29 in interlocked, coupled relation with an opposing coupler.

A flat, vertically disposed and rectangular-shaped thrower pad 48 is formed between the top and bottom sides 42 and 43 of the standard knuckle 29 between the pin hole 38 and tail 33 in predetermined spaced relation from the pin hole 38. The thrower pad 48 is designed to be engaged by a conventional thrower (not shown) which is rotated in a horizontal plane to rotate the standard knuckle 29 to an open, uncoupled position, when a standard toggle mechanism (not shown) is actuated by an operator to raise the lock onto the lock ledge 47 to permit rotation of the standard knuckle 29.

The nose 34 is provided with a curved pulling face 49 opposite the front face 32, and a pair of similar buffing shoulders 50 are formed on the top and bottom sides 42 and 43 of the standard knuckle 29 between the pin protectors 37 and the pulling lugs 40 and 41 in predetermined spaced relation from the pin hole 38.

The Invention

Figure 6:
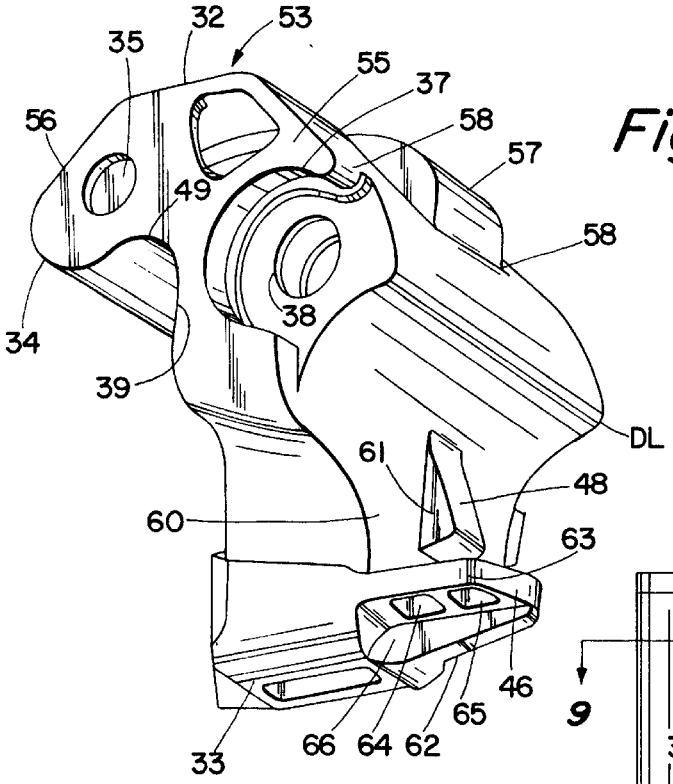
FIG. 6 is a perspective view of the first lightweight knuckle.
Figure 16:
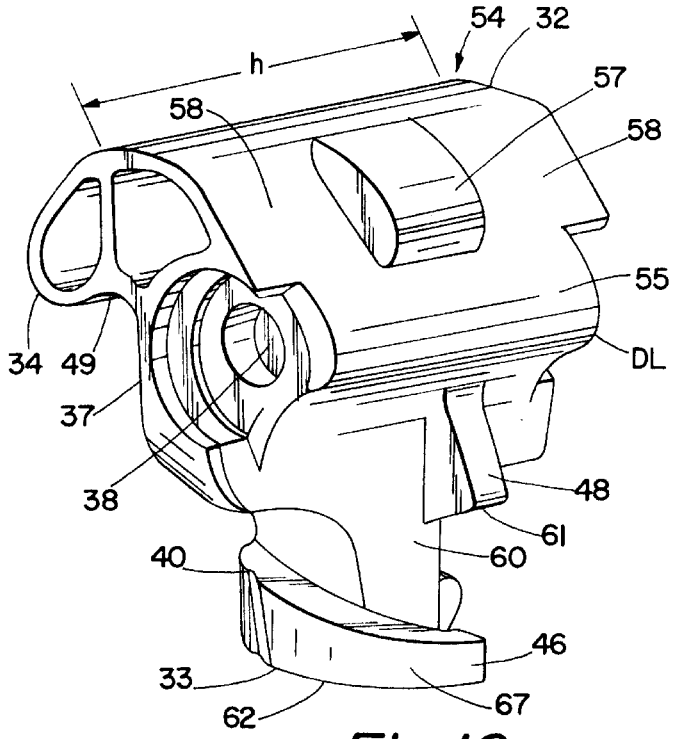
FIG. 16 is a perspective view of a second, preferred lightweight knuckle which is made in accordance with the invention.

The following disclosure of the invention covers a first lightweight emergency knuckle 53 and a second, preferred lightweight emergency knuckle 54 which are best seen, in perspective, in FIGS. 6 and 16, respectively, and which are adaptations of the AAR Standard knuckle 29, i.e. both lightweight knuckles 53,54 have similar bodies 55 which have radically different outer shapes and inner voids, yet have the parts necessary to function like the standard knuckle 29. The two lightweight knuckles 53,54 for explanation and claiming purposes, are assumed to be in similar horizontal positions where the front faces 32 thereof face in a northerly direction and the tails 33 thereof face in a southerly direction.

With particular reference to FIGS. 4–9 and 16–17, the two lightweight knuckles 53,54, each have a similar nose 34 that is provided with a flat, not rounded, side 56 which faces in a northwesterly direction and substantially reduces the amount of material in this area without adversely effecting the interlocking action of the nose 34. The provision of the flat side 56 necessitates moving the flag hole 35, found only in the first lightweight knuckle 53, inwardly in an easterly direction to insure that there is adequate material between the flat side 56 and the flag hole 35.

Another adaptation involves reducing the overall height H of the nose 34 of the standard knuckle 29 from eleven inches (11") to about nine and seventy-eight hundredths inches (9.78") which is the overall height h of the standard knuckle 29 and lightweight knuckles 53,54, including the noses 34 thereof. Such reduction in nose height eliminates a significant amount of material and has no adverse coupling effect on AAR Standard type F couplers, because of the interlocking relationship of the guard arm noses 24 and pockets 28. In fact, the shorter nose height increases the capability of vertical angling between interlocked couplers, which is beneficial in most cases. However, such increased capability of angling may be critical to the interlocking relationship of AAR Standard type E couplers which do not have guard arms and pockets to restrict angling.

A unique heel 57 is provided on each of the lightweight knuckles 53,54, and has the same outer curved contour, as the heel 36 of the standard knuckle 29, for engaging and deflecting the guard arm nose 27 of a coupler into the pocket 28 of an opposing AAR Standard type F coupler. It can be seen that top and bottom curved portions of the standard heel 36 have been removed and replaced by similarly sized, coplanar flat surfaces 58 which face in a northeasterly direction and extend from the front face 32 to the edges of the recessed surfaces 59 of the pin holes 38. The heel 57 separates the coplanar surfaces and projects therefrom. Thus, the heel 57 is much narrower, in width, than the standard heel 36, and is a substantial weight reduction measure.

Figure 4:
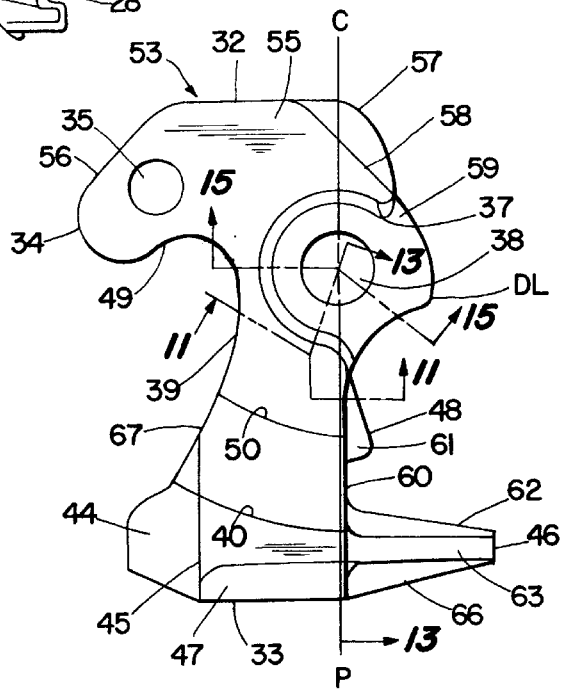
FIG. 4 is a plan view of a first, lightweight knuckle which is made in accordance with the invention.
Figure 17:
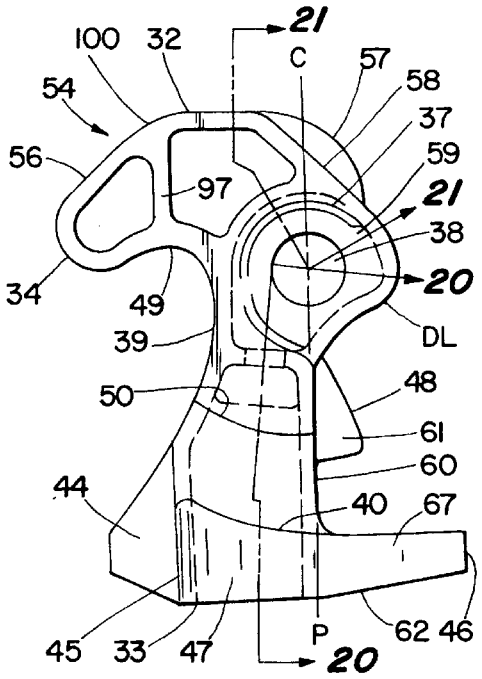
FIG. 17 is a plan view of the preferred lightweight knuckle.

It can be appreciated from a comparison of FIG. 2 with FIGS. 4 and 17, that the easterly or knuckle side 60 of each of the lightweight knuckles 53,54, has been radically changed between the pin hole 38 and the tail 33 to eliminate material and substantially reduce the weight of the lightweight knuckles 53,54. For example, beginning at a vertical demarkation line DL which is almost due east of the bottom of the pin hole 38 closest the tail 33, the easterly side 60 of each of the lightweight knuckles 53,54, curves inwardly to substantially the center plane CP where it flattens out until it reaches the tail 33, leaving behind only an exposed, triangular shaped projection 61 with a similar, rectangular shaped thrower pad 48 for engagement with the thrower. The demarcation line DL is where each of the lightweight knuckles 53,54, meets the coupler head 25, when the lightweight knuckles 53,54, are in a closed, coupled position. It is important to maintain a minimal spacing between each of the lightweight knuckles 53,54, and the coupler head 25 at the demarkation line DL to prevent particulate matter from entering the coupler head 25 and adversely affecting operation of the many parts therein. The demarcation line DL can be moved northerly in the direction of the projecting heel 57 to further eliminate material and reduce the weight of the lightweight knuckles 53,54, but such movement increases the spacing between the lightweight knuckles 53,54, and coupler head 25, as previously described, so that a compromise has to be made between weight reduction and operability of the coupler.

Figure 7:
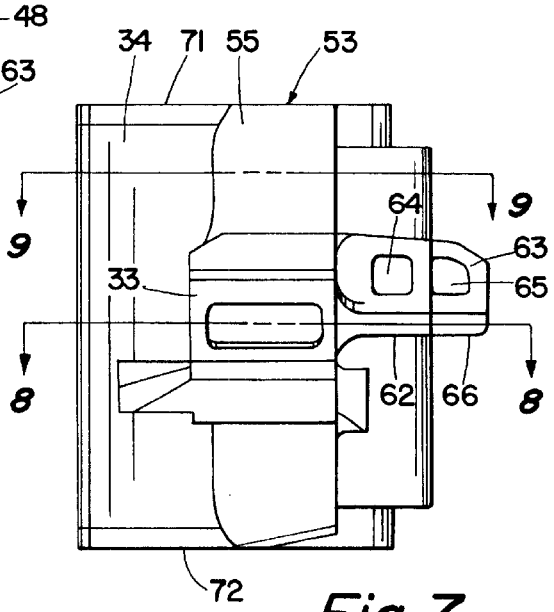
FIG. 7 is an end view of the first lightweight knuckle.

The flat, easterly side 60 of the lightweight knuckles 53,54, terminates at a unique tail stop assembly 62 which extends easterly from the tail 33 and, in the case of the first lightweight knuckle 53, comprises I) an elongated first plate 63 which is vertically disposed and has a rectangular cross section and two separated voids 64 and 65 to lighten the first plate 63, as best seen in FIGS. 6 and 7, and II) a triangular, second plate 66 which is horizontally disposed and integral with the first plate 63, the two elongated plates 63 and 66 extending easterly from the tail 33 and terminating at the flat, vertical tail stop 46, as previously described. This unique T-shaped tail stop assembly 62 is sturdy and lightweight and certainly not as bulky and as heavy as the corresponding area of the standard knuckle 29. The tail stop assembly 62 of the second lightweight knuckle 54 comprises an elongated, tapering arm 67 which is narrower and not as bulky as the T-shaped tail stop assembly 62 of the first lightweight knuckle 53. Moreover, the elongated arm 67 has a rectangular cross-section which diminishes, in size, in a direction towards the flat, vertical tail stop or abutment 46.

The lightweight knuckles 53,54, each have a lock ledge 47 which is slightly reduced, in width, so that the overall length of each of the lightweight knuckles 53,54, measured from the northerly most front face 32 to the southerly most tail 33 is reduced to further lighten the lightweight knuckles 53,54, without adversely effecting the operation thereof.

The size of the lock shelf 44 on the westerly or guard arm side 68 of each of the lightweight knuckles 53,54, has been only slightly modified, since it is necessary to maintain the anti-creep toggle below the lock shelf 44, so as to prevent the lock from lifting off the lock shelf 44 a distance sufficient to cause the lightweight knuckles 53,54, to open unexpectedly.

The foregoing are the main cosmetic differences between the lightweight knuckles 53,54, and an AAR Standard knuckle 29 with a full service rating. The functioning parts of a standard knuckle 29 have not been radically altered in the lightweight emergency knuckles 53,54, but remain pretty much the same. Other weight reduction in the lightweight knuckles 53,54, is achieved by substantially changing the internal coring or voids within the lightweight knuckles 53,54, from those within a standard knuckle 29. For example, certain wall thicknesses in the lightweight knuckles 53,54, have been reduced, and voids have been placed in areas of minimal stress, while using reinforcement webs where necessary. The coring or void structure within the two lightweight knuckles 53,54, varies slightly, but enough to warrant a brief description of each one.

Figure 5:
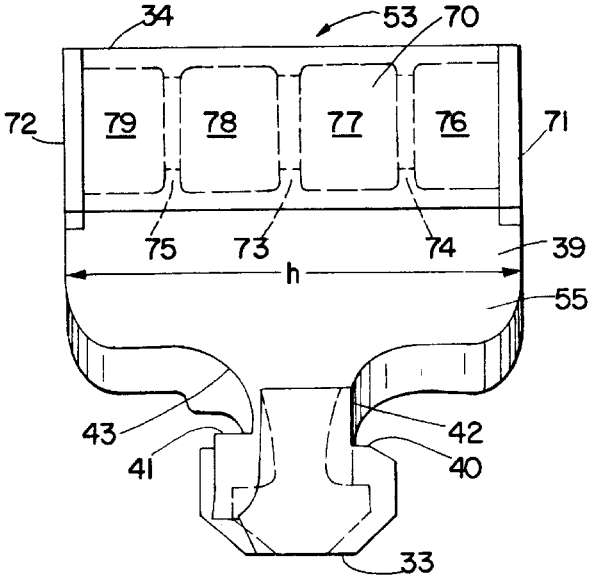
FIG. 5 is a guard arm side view of the first lightweight knuckle.
Figure 8:
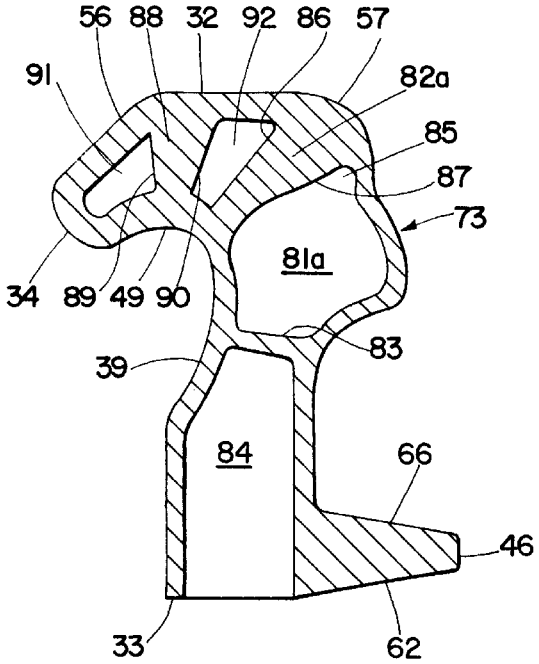
FIG. 8 is a section of the first lightweight knuckle, as viewed from the line 8—8 of FIG. 7.
Figure 9:
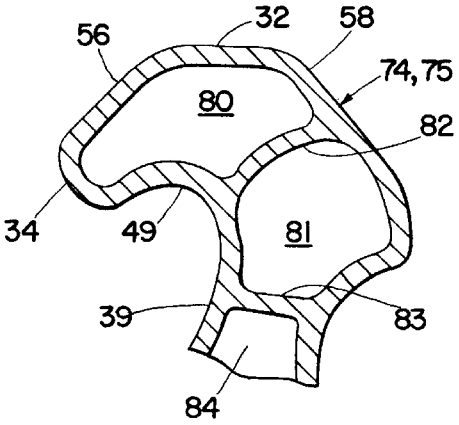
FIG. 9 is a section of the first lightweight knuckle, as viewed from the line 9—9of FIG. 7.
Figure 10:
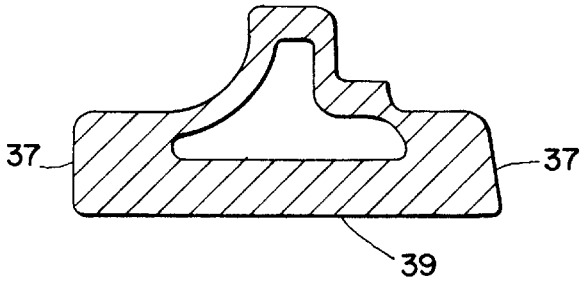
Fig. 10 (PRIOR ART)
FIG. 10 is a section of the AAR Standard knuckle, as viewed from the line 10—10of FIG. 2.
Figure 11:
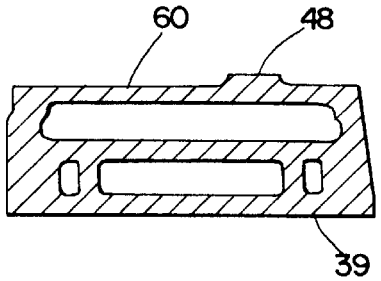
FIG. 11 is a section of the first lightweight knuckle, as viewed from the line 11—11 of FIG. 4.
Figure 12:
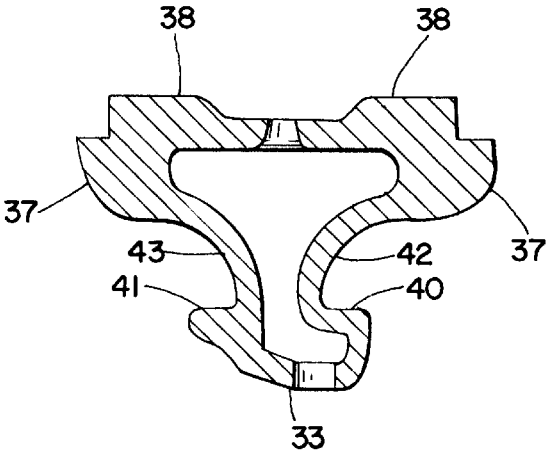
Fig. 12 (PRIOR ART)
FIG. 12 is a section of the AAR Standard knuckle, as viewed from the line 12—12 of FIG. 2.
Figure 13:
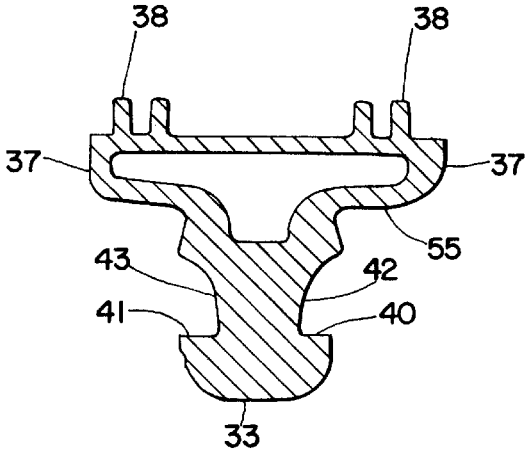
FIG. 13 is a section of the first lightweight knuckle, as viewed from the line 13—13 of FIG. 4.
Figure 14:
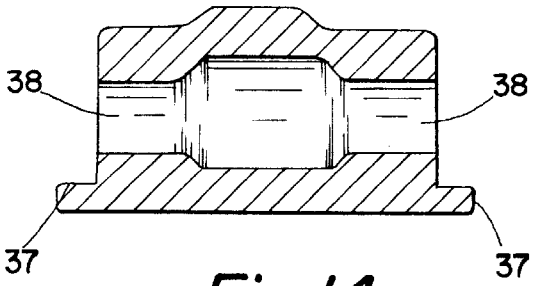
Fig. 14 (PRIOR ART)
FIG. 14 is a section of the AAR Standard knuckle, as viewed from the line 14—14 of FIG. 2.
Figure 15:
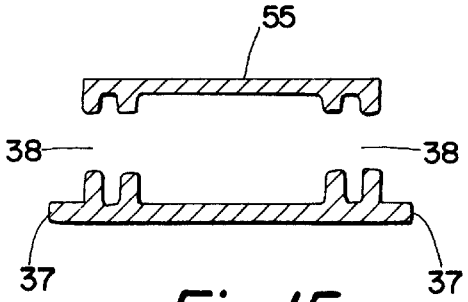
FIG. 15 is a section of the first lightweight knuckle, as viewed from the line 15—15 of FIG. 4.

The first lightweight knuckle 53 in the areas of the nose 34, front face 32, and pin hole 38, as best seen in FIGS. 5, 8 and 9, is provided with a large vertically disposed void 70 which extends between, I) a top plate 71 which is solid, except for the flag hole 35 and is vertically offset by the vertically uppermost top pin protector 37 and includes the top pin hole 38, and II) a bottom plate 72 which is vertically offset by the vertically lowermost bottom pin protector 37 and includes the bottom pin hole 38. A horizontally disposed center web 73 and two, similar, parallel and thinner auxiliary webs 74,75, vertically divide the large void 70 into four smaller voids 76–79 which are successively marked from top to bottom of the lightweight knuckle 53. The thicker, center web 73 vertically bisects the lightweight knuckle 53, and is in the area of the heel 57, whereas the first auxiliary web 74 is between the center web 73 and top plate 71, and the second auxiliary web 75 is between the center web 73 and bottom plate 72.

The two auxiliary webs 74,75, as best seen in FIG. 9, are in the area of the flat surfaces 58 from which the heel 57 protrudes, and include two irregularly shaped openings 80,81, which are separated by a solid partition wall 82 which extends in curved relation from the easterly side of the pulling face 49 to about midway of the flat surfaces 58 in the area of the heel 57. The first opening 80 is in the area of the front face 32 and nose 34, whereas the second opening 81 is in the area of the pin holes 38, and is bounded on the south by a second partition wall 83 which separates the second opening 81 from a large void 84 which extends from the second partition wall 83 in a southerly direction and terminates at the tail 33 of the lightweight knuckle 53.

The center web 73, as previously indicated, is in the area of the heel 57 and was believed to require beefing-up in the area bounded by the pulling face 49, the rounded nose 34, the flat surface 56 on the nose 34, the front face 32, and the heel 57. It can been seen from a comparison of FIGS. 8 and 9, that the center web 73, has, in the area of the pin holes 38, an opening 81*a* which is similar in size and shape to the corresponding opening 81 in the auxiliary webs 74,75, except that the northerly tip 85 of the opening 81*a* extends slightly into the area of the heel 57. The relatively thin partition wall 82 of the auxiliary webs 74,75, has been enlarged to form in the center web 73, a corresponding partition wall 82*a* whose opposing sides 86 and 87 generally diverge in the direction of the heel 57 to provide a much wider and stronger partition wall 82*a* to reinforce the heel 57. A second partition wall 88 is provided in the center web 73 between the pulling face 49 and the front face 32. This second partition wall 88 has a pair of opposing sides 89 and 90 which diverge in the direction of the front face 32 to provide a strong partition wall for reinforcing the front face 32. It should also be noted that the walls of the pulling face 49, the rounded nose 34 and flat side 56 thereon, and the front face 32 have been substantially increased, in thickness, from the corresponding walls of the auxiliary webs 74,75, so that the large opening 80 of the auxiliary webs 74,75, is radically divided into two small openings 91 and 92.

Figure 18:
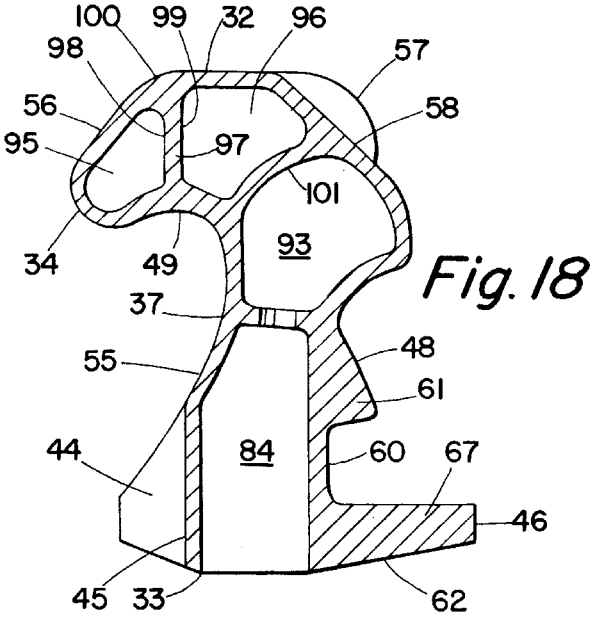
FIG. 18 is a cross sectional plan view bisecting the preferred lightweight knuckle as seen in FIG. 17.
Figure 19:
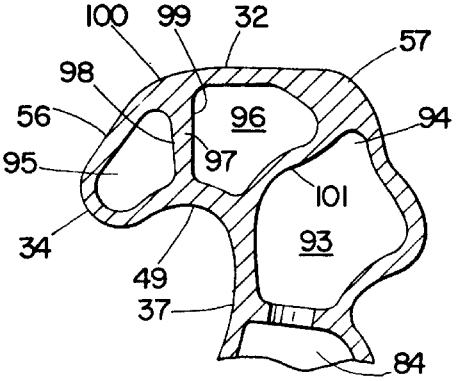
FIG. 19 is similar to FIG. 18, but of a parallel, partial cross sectional plan view of the preferred lightweight knuckle.
Figure 21:
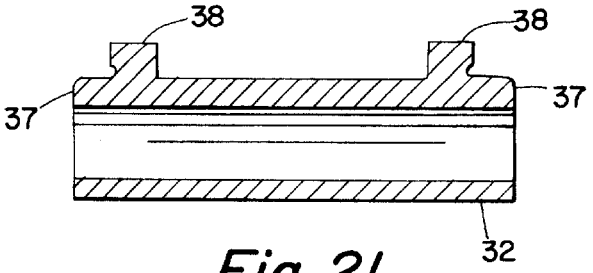
FIG. 21 is a section of the preferred lightweight knuckle viewed from the line 21—21 of FIG. 17.
Figure 20:
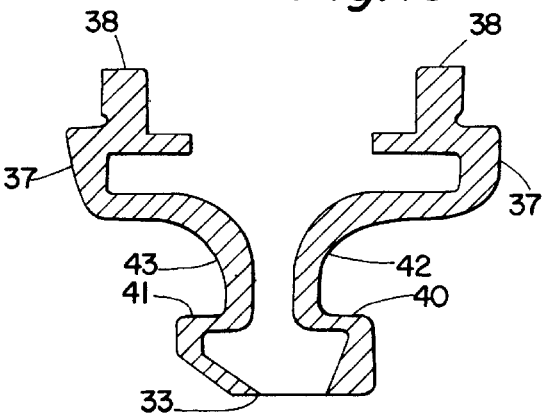
FIG. 20 is a section of the preferred lightweight knuckle viewed from the line 20—20 of FIG. 17.

With particular reference to FIGS. 17–19, the preferred lightweight knuckle 54 has a coring or void structure which, in some areas, is identical to that of the first lightweight knuckle 53 and, in other areas, is totally different. For example, a comparison of FIGS. 18 and 19 with FIGS. 8 and 9, reveals that, in the area of the pin holes 38, the preferred lightweight knuckle 54 has a continuous, vertical void 93 which extends between the top and bottom pin holes 38, and has a size and shape which is practically identical to the size and shape of the correspondingly located opening 81 in each of the auxiliary webs 74,75. Moreover, the vertical void 93 has a northerly tip 94 which is expanded slightly into the heel 57, so that at this horizontal plane, the expanded void 93 has a size and shape which is practically identical to that of the opening 81*a* in the center web 73 of the first lightweight knuckle 53. The preferred lightweight knuckle 54 has, in the area of the nose 34 and front face 32, two vertical voids 95 and 96 which are coextensive with the height h of the nose 34 and are open at the opposing ends thereof. The opening 95, closest the rounded nose 34, is designed as a flag opening 35. The two voids 95,95, are separated by a coextensive partition wall 97 which has flat, parallel walls 98 and 99, and extends between the pulling face 49 and the juncture 100 of the front face 32 with the flat surface of face 56 of the nose 34. The coextensive partition wall 101, separating the voids 93 and 96, is similar in shape and thickness to the partition wall 82 which separates the openings 80 and 81 in the auxiliary webs 74,75. It should be noted that for simplification of the casting process which is used to initially form the preferred lightweight knuckle 53, the sides of the three voids 93,95 and 96 are made flat and straight from end-to-end whenever possible.

FIGS. 10–15, 20 and 21, are designed to provide those skilled in the art with a comparison of similar sections of the AAR Standard knuckle 29 and the unique lightweight knuckles 53 54, for the purpose of showing how, through the use of finite element analysis (FEA), certain walls of the lightweight knuckles 53,54, have been substantially decreased, in thickness, without destroying their structural integrity, so that the lightweight knuckles 53,54, can be used temporarily in an emergency to replace AAR Standard knuckles 29 which, although being designed using more stringent criteria and design parameters, become damaged and inoperable during use and require replacement.

Thus, there has been described two unique lightweight knuckles, which can, in an emergency, replace existing AAR Standard knuckles which become broken or otherwise damaged and inoperable during operation. AAR Standard knuckles are almost twice the weight of these lightweight knuckles whose performance is not compromised by the removal of material which, according to a careful FEA, has been found to be excessive and not critical to the operation of these lightweight knuckles which are cast from industry standard grade "E" steel alloy material from which AAR Standard knuckles are made. It may be possible in the future to produce an AAR Standard lightweight knuckle using the disclosed technology in combination with a stronger metal or alloy.

What is claimed is:

1. A lightweight knuckle for a railroad car coupler, comprising a body which, I) has internal voids and an outer configuration which are different from an existing AAR Standard knuckle, II) weighs substantially less than an existing AAR Standard knuckle, III) has functioning parts which include a nose, a pulling face, a front face, a pin hole, a tail, a tail stop, a pair of pulling lugs, buffing shoulders, a thrower pad, a lock shelf and locking face, and a lock ledge, all of which parts function the same as corresponding parts of an existing AAR Standard knuckle such that, when the lightweight knuckle is installed in a railroad car coupler, it will function like an existing AAR Standard knuckle, including the rotary function of the knuckle during coupling and uncoupling of the knuckle.

2. A lightweight knuckle for a railroad car coupler, comprising a body which, I) has internal voids and an outer configuration which are different from an existing AAR Standard knuckle, II) weighs substantially less than such an AAR Standard kncukke, and III) when installed, can operate as such an AAR Standard knuckle, the knuckle having a pin hole, a tail, and a tail stop and wherein the body, includes;

a) an easterly side which, approximately due east of the bottom of the pin hole closest the tail of the knuckle, curves inwardly of the body to substantially the center plane of the knuckle and then becomes substantially flat as it extends in a direction towards the tail.

3. The knuckle of claim 2, which includes:

b) a triangular-shaped projection which extends outwardly from the substantially flat easterly side of the knuckle, the projections having a flat, rectangular pad which is angularly disposed to the substantially flat easterly side of the knuckle, and which is designed to engage a thrower used in a coupler head.

4. The knuckle of claim 3, wherein of the body, includes:

c) a heel which is sufficiently wide and curved to engage and deflect a guard arm nose of an AAR Standard type F coupler, the heel projecting from between a pair of coplanar flat surfaces which face in a northeasterly direction.

5. The knuckle of claim 4, which includes a front face and nose, and wherein the body, includes:

d) a flat surface on the nose coextensive with the height of the nose, the flat surface on the nose intersecting the front face and facing in a northwesterly direction.

6. The knuckle of claim 5, wherein the body includes, a top side in vertical spaced relation above a bottom side, and a pair of oppositely disposed buffing shoulders on the top and bottom sides of the body, and wherein the vertical height of the nose is the same as the vertical height of the coplanar surfaces from which the heel projects.

7. The knuckle of claim 6, which includes:

e) a vertically uppermost top plate having a flag hole therein; and f) a vertically lowermost bottom plate in spaced relation below the top plate, the top and bottom plates being vertically offset towards each other to form a pair of vertically aligned pin holes.

8. The knuckle of claim 7, which includes a throat and pulling face, and wherein the body in an area generally bounded by the throat, pulling face, nose, front face, heel and pin hole, includes:

j) a large vertical void disposed within the body of the knuckle between the top and bottom plates;

k) a horizontal center web vertically bisecting the vertical void, the center web having at least two openings therein separated by a solid partition well which has a pair of opposing sides which generally diverge in a direction towards the heel;

m) a first auxiliary web disposed horizontally between the center web and top plate, the first auxiliary web having at least two openings therein separated by a solid partition which has curved, generally parallel opposing sides which also extend in a direction towards the heel;

n) a second auxiliary web which is identical to the first auxiliary web, and which is horizontally disposed between the center web and bottom plate; and o) a second solid partition wall disposed in the center web between the pulling face and front face of the knuckle, the second partition wall having a pair of opposing sides which diverge in a direction towards the front face of the knuckle.

9. The knuckle of claim 8, in combination with an AAR Standard coupler of the group of type E, and F couplers.

10. The knuckle of claim 7, wherein the tail stop, includes:

g) a vertical plate with a rectangular cross section extending from the tail in an easterly direction; and h) a horizontal, triangular plate integral with the vertical place and extending from the tail in an easterly direction, the vertical plate being centrally disposed on the triangular plate, the plates terminating at a vertical tail stop.

11. The knuckle of claim 10, wherein the vertical plate has at least one opening extending therethrough.

12. The knuckle of claim 10, which includes a throat and pulling face, and wherein the body in an area generally bounded by the throat, pulling face, nose front face, heel and pin hole, includes:

j) a large vertical void disposed within the body of the knuckle between the top and bottom plates;

k) a horizontal center web vertically bisecting the vertical void, the center web having at least two openings therein separated by a solid partition wall which has a pair of opposing sides which generally diverge in a direction towards the heel;

m) a first auxiliary web disposed horizontally between the center web and top plate, the first auxiliary web having at least two openings therein separated by a solid partition which has curved, generally parallel opposing sides which extend in a direction of the heel;

n) a second auxiliary web which is identical to the first auxiliary web, and which is horizontally disposed between the center web and bottom plate; and o) a second solid partition wall disposed in the center web between the pulling face and front face of the knuckle, the second partition wall having a pair of opposing sides which diverge in a direction towards the front face of the knuckle.

13. The knuckle of claim 6, wherein the tail stop includes an elongated arm which extends easterly from the tail and terminates at the tail stop, the arm having a rectangular cross section which diminishes, in size, in a direction towards the tail stop.

14. The knuckle of claim 13, wherein the pin hole includes a pair of vertically aligned pin holes, and the knuckle includes a pulling face and at least three vertically disposed voids therein, the first and second voids being coextensive with the nose and front face and having opposing ends which are open to eh ambient atmosphere, the first and second voids being separated by a coextensive partition wall which is solid and extends between the pulling face and front face of the knuckle, the third void extending between the pin holes and separated from the adjacent second void by a coextensive partition wall which extends between the easterly side of the pulling face and the heel.

15. The knuckle of claim 14, wherein the partition walls between the first and second voids has a pair of parallel and flat opposing sides, and the walls of the three voids are flat wherever possible to simplify forming the voids within the knuckle.

16. The knuckle of claim 15, in combination with an AAR Standard coupler of the group of type E, and F couplers.

17. A lightweight knuckle for a railroad car coupler comprising a body having a nose, a pulling face, a throat, a front face, a pair of pin protectors adjacent a pair of vertically aligned recessed pin holes, a tail, a tail stop, top and bottom pulling lugs and buffing shoulders, a thrower pad, a lock shelf and locking face, and a lock ledge, the lightweight knuckle characterized by;

a) an easterly side which, approximately due east of the bottom of the pin hole closest the tail of the knuckle, curves inwardly of the body to substantially the center plane of the knuckle and then becomes substantially flat as it extends in a southerly direction towards the tail;

b) a triangular projection extending from the easterly side of the knuckle in an easterly direction, the projection having a northeasterly facing, flat thrower pad which is designed to engage a thrower used in the coupler head;

c) a heel which is sufficiently wide to engage and deflect a guard arm nose of an AAR Standard type F coupler, the heel projecting from between a pair of coplanar flat surfaces which face in a northeasterly direction;

d) a flat surface on the nose coextensive with the height of the nose, the flat surface on the nose intersecting the front face and facing in a northwesterly direction, the flat surface and nose having the same vertical height as the front face and coplanar flat surfaces from which the heel projects;

e) a tail stop assembly extending from the tail in an easterly direction and terminating at a tail stop;

f) at least one void disposed vertically in the knuckle in the area generally bounded by the throat, the pulling face, the rounded nose and flat surface on the nose, the front face, the coplanar surfaces and heel, and the pin protectors and pin holes, the void being at least substantially coextensive with the front face.

18. The knuckle of claim 17, wherein the tail stop assembly includes an elongated arm which has a rectangular cross section which diminishes, in size, in a direction towards the tail stop.

19. The knuckle of claim 18, wherein the void is coextensive with the front face and has a pair of opposing ends which are open to the ambient atmosphere, and which includes a pair of vertical partition walls which are coextensive with the void and separate the void into three smaller voids, the first of the three voids being in the area of the nose, the second of the three voids being in the area of the front face, and the third of the three voids being in the area of the pin holes, the first and second voids being separated by the first of the pair of partition walls, the first partition wall disposed between the pulling face and juncture of the front face with the northwesterly facing flat surface on the nose, the second and third voids being separated by the second of the pair of partition walls which extends between the easterly side of the pulling face and the northeasterly facing coplanar flat surfaces in the area of the heel, the sides of the partition walls and voids being vertically flat whenever possible.

20. The knuckle of claim 17, wherein the tail stop assembly includes:

I) a vertical plate with a rectangular cross section extending from the tail in an easterly direction, the vertical plate having at least one void extending therethrough; and II) a horizontal, triangular plate integral with the vertical plate and extending from the tail in an easterly direction, the vertical plate being centrally disposed on the triangular plate, the plates terminating at a tail stop, the knuckle including:

III) a horizontal center web traversing and vertically bisecting the void, the center web including, i) a first partition wall which is disposed between the pulling face and front face and has a pair of opposing sides which diverge in a direction towards the front face, and ii) a second partition wall which is disposed from the easterly side of the pulling face and the heel and has a pair of opposing sides which generally diverge in a direction towards the heel; and IV) a pair of similar, horizontal auxiliary webs transvering the void, the first of the pair of auxiliary webs disposed between the center web and vertically uppermost top of the knuckle, and the second of the pair of auxiliary webs being disposed between the center web and vertically lowermost bottom of the knuckle, the auxiliary webs each having a partition wall which is disposed between the easterly side of the pulling face and the coplanar sides in general alignment with the heel.

* * * * *